US009644480B2

(12) United States Patent
Iwanaji et al.

(10) Patent No.: US 9,644,480 B2
(45) Date of Patent: May 9, 2017

(54) FLUID PRESSURE ROTARY MACHINE

(71) Applicant: KAYABA INDUSTRY CO., LTD., Tokyo (JP)

(72) Inventors: Tetsuya Iwanaji, Kanagawa (JP); Atsushi Aoyama, Kanagawa (JP)

(73) Assignee: KYB Corporation, Tokyo (JP)

( * ) Notice: Subject to any disclaimer, the term of this patent is extended or adjusted under 35 U.S.C. 154(b) by 410 days.

(21) Appl. No.: 14/374,524

(22) PCT Filed: Jul. 18, 2013

(86) PCT No.: PCT/JP2013/069477
§ 371 (c)(1),
(2) Date: Jul. 24, 2014

(87) PCT Pub. No.: WO2014/027542
PCT Pub. Date: Feb. 20, 2014

(65) Prior Publication Data

US 2014/0360351 A1 Dec. 11, 2014

(30) Foreign Application Priority Data

Aug. 13, 2012 (JP) ..... 2012-179305

(51) Int. Cl.
*F01B 3/00* (2006.01)
*F04B 1/20* (2006.01)
(Continued)

(52) U.S. Cl.
CPC ..... *F01B 3/007* (2013.01); *F01B 3/0055* (2013.01); *F01B 3/0091* (2013.01);
(Continued)

(58) Field of Classification Search
CPC .... F01B 3/0047; F03C 1/0647; F04B 1/2021; F04B 1/2028
See application file for complete search history.

(56) References Cited

U.S. PATENT DOCUMENTS 3,444,690 A * 5/1969 Henry-Biabaud ..... B60K 17/10 60/485
2010/0000401 A1* 1/2010 Beck ..... F04B 1/2021 92/12.2
2013/0000481 A1 1/2013 Ohno et al.

FOREIGN PATENT DOCUMENTS

CH 257509 A * 10/1948 ..... F01B 3/0041
DE 1126735 B * 3/1962 ..... F01B 3/0047
(Continued)

OTHER PUBLICATIONS

Japanese Office Action dated Jul. 19, 2016.

*Primary Examiner* — Eric Keasel
*Assistant Examiner* — Matthew Wiblin
(74) *Attorney, Agent, or Firm* — Rabin & Berdo, P.C.

(57) ABSTRACT

A fluid pressure rotary machine includes a cylinder block that is fixed to a rotary shaft and includes a plurality of cylinder bores, a piston disposed to be free to slide in each cylinder bore such that a volume chamber is defined thereby, a swash plate that causes the piston to reciprocate such that the volume chamber expands and contracts, and a valve plate that slides against the cylinder block and includes an intake port and a discharge port communicating with the volume chamber. The valve plate includes a sliding surface formed to project in a spherical shape against the cylinder block. The cylinder block includes a sliding surface formed as an indentation corresponding to the shape of the sliding surface of the valve plate. A minute gap is formed between the sliding surface of the valve plate and the sliding surface of the cylinder block in an outer edge position.

2 Claims, 5 Drawing Sheets

(51) Int. Cl.
*F04B 1/22* (2006.01)
*F03C 1/06* (2006.01)

(52) U.S. Cl.
CPC ..... *F03C 1/0647* (2013.01); *F04B 1/2021* (2013.01); *F04B 1/2035* (2013.01); *F04B 1/22* (2013.01)

(56) References Cited

FOREIGN PATENT DOCUMENTS

| | | | | | |
|---|---|---|---|---|---|
| DE | 19924834 | A1 | * | 11/2000 | ..... F04B 1/2021 |
| DE | 102008060067 | A1 | * | 6/2010 | ..... F04B 1/2021 |
| FR | 1414056 | A | * | 10/1965 | ..... F01B 3/0047 |
| GB | 1095821 | A | * | 12/1967 | ..... F01B 3/0047 |
| JP | S33-009341 | | | 10/1958 | |
| JP | S59-5777 | U | | 1/1984 | |
| JP | S60-34570 | U | | 3/1985 | |
| JP | H03-156176 | A | | 7/1991 | |
| JP | H11-22654 | A | | 1/1999 | |
| JP | 2000-018149 | A | | 1/2000 | |
| JP | 2004-340083 | A | | 12/2004 | |
| JP | 2005-337107 | A | | 12/2005 | |
| JP | 2007-255215 | A | | 10/2007 | |
| JP | 2012-082747 | A | | 4/2012 | |
| WO | WO 2012-066593 | A1 | | 5/2012 | |

* cited by examiner

FLUID PRESSURE ROTARY MACHINE

TECHNICAL FIELD

The present invention relates to a fluid pressure rotary machine such as a swash plate type piston pump/motor.

BACKGROUND ART

Japanese Patent Application Publication No. 2012-82747 discloses a piston pump/motor including a cylinder block that is fixed to a rotary shaft and includes a plurality of cylinder bores, a piston disposed to be free to slide in each cylinder bore such that a volume chamber is formed thereby, a swash plate that causes the piston to reciprocate as the cylinder block rotates such that the volume chamber expands and contracts, and a valve plate that slides against the cylinder block and includes an intake port and a discharge port communicating with the volume chamber.

SUMMARY OF INVENTION

In the piston pump/motor described above, the valve plate includes a sliding surface formed to project in a spherical shape against the cylinder block, while the cylinder block includes a sliding surface that is recessed in a spherical shape in accordance with the shape of the sliding surface of the valve plate. A curvature radius of the sliding surface of the cylinder block and a curvature radius of the sliding surface of the valve plate are set to be identical such that the cylinder block and the valve plate slide against each other without gaps.

During an operation of the piston pump/motor, a shoe provided on a tip end of the piston slides relative to the swash plate such that a reaction force corresponding to a working oil pressure in the volume chamber acts on the piston from the swash plate side. The working oil pressure in the volume chamber in a position of a discharge region is high, and therefore the reaction force acting on the piston increases in the discharge region. When this large reaction force acts on the rotary shaft via the cylinder block, the rotary shaft bends, and the bending of the rotary shaft causes the cylinder block to tilt. When the cylinder block tilts, a contact pressure by which the valve plate contacts the cylinder block on an outer edge part of the sliding surface thereof becomes excessively large, and as a result, partial wear occurs on the valve plate and the cylinder block.

An object of the present invention is to provide a fluid pressure rotary machine in which an excessive increase in contact pressure between a valve plate and a cylinder block can be suppressed.

According to an aspect of the present invention, a fluid pressure rotary machine includes a cylinder block that is fixed to a rotary shaft and includes a plurality of cylinder bores, a piston disposed to be free to slide in each cylinder bore such that a volume chamber is defined thereby, a swash plate that causes the piston to reciprocate as the cylinder block rotates such that the volume chamber expands and contracts, and a valve plate that slides against the cylinder block and includes an intake port and a discharge port communicating with the volume chamber. The valve plate includes a sliding surface formed to project in a spherical shape against the cylinder block. The cylinder block includes a sliding surface formed as an indentation corresponding to the shape of the sliding surface of the valve plate. A minute gap is formed between the sliding surface of the valve plate and the sliding surface of the cylinder block in an outer edge position.

DESCRIPTION OF EMBODIMENTS

First Embodiment

Referring to FIGS. 1 to 4, a hydraulic rotary machine 100 (a fluid pressure rotary machine) according to a first embodiment of the present invention will be described below.

Figure 1:
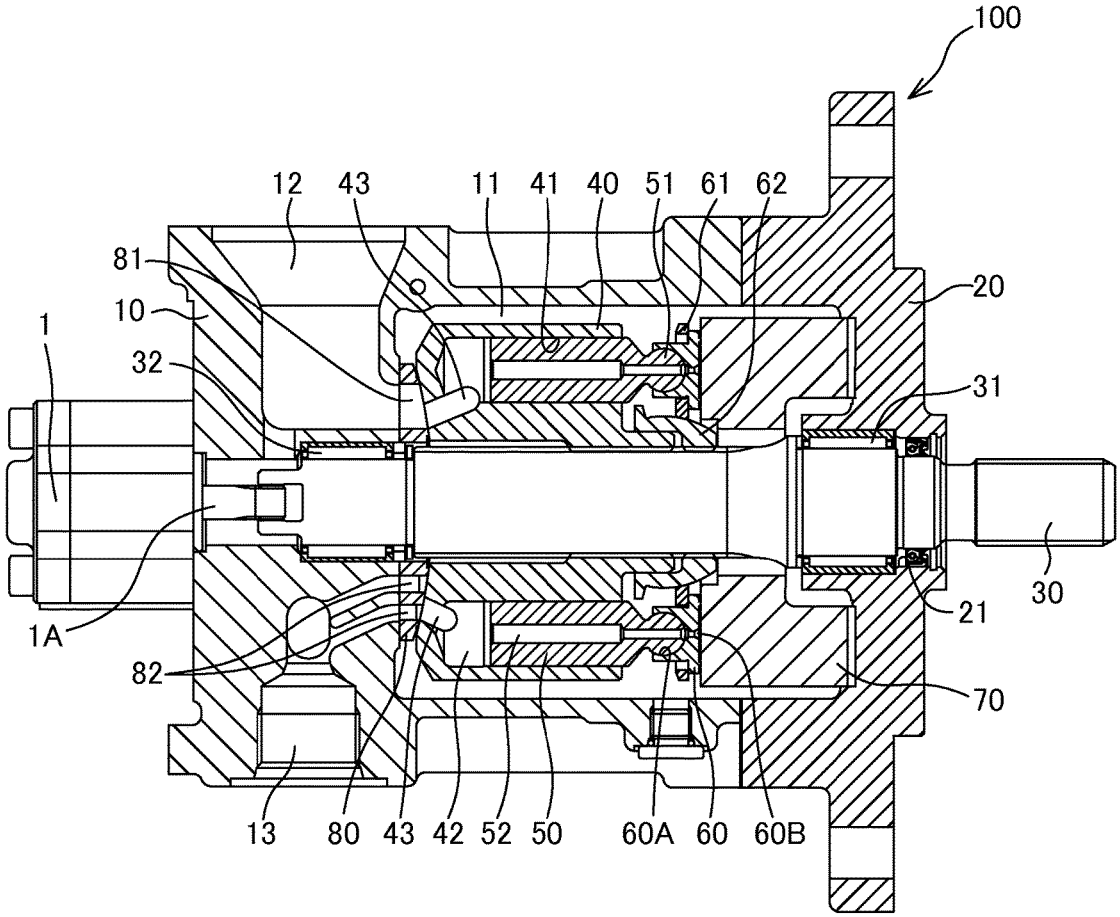
FIG. 1 is a sectional view showing a hydraulic rotary machine according to a first embodiment of the present invention.
Figure 2:
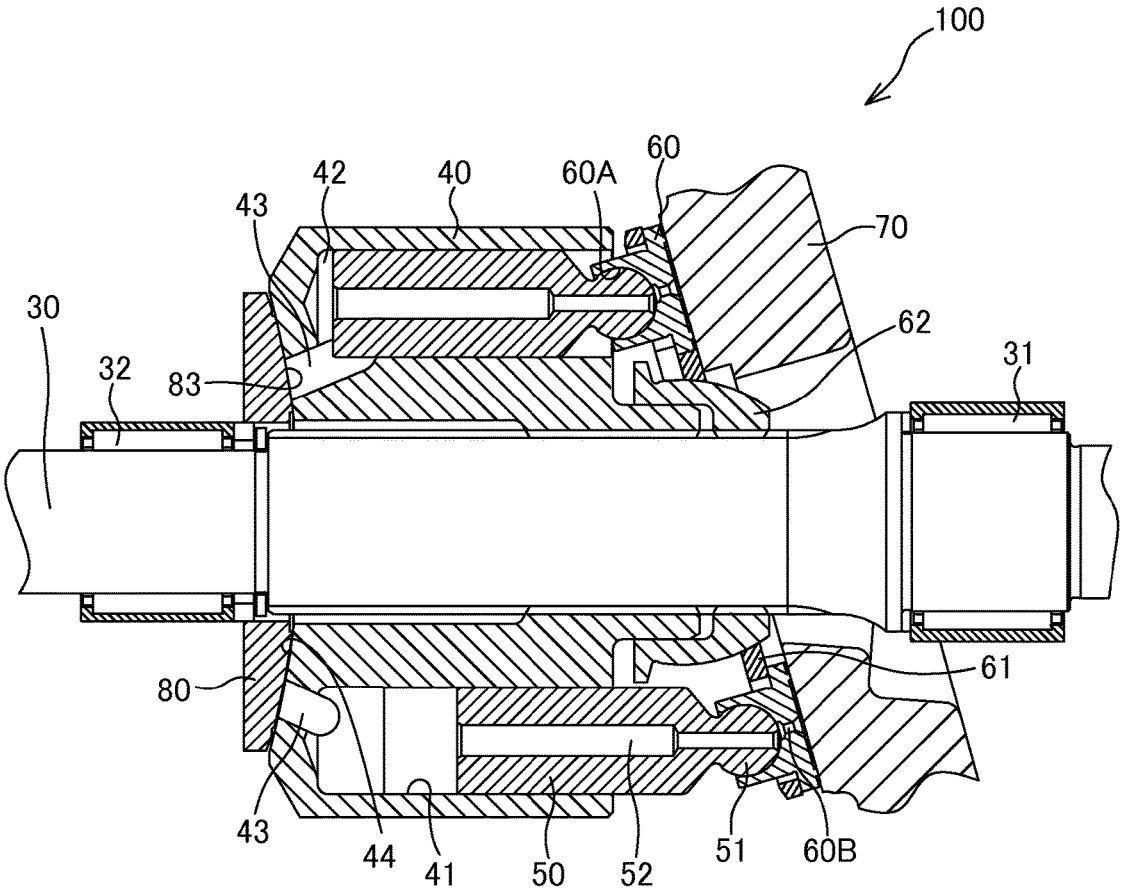
FIG. 2 is a partial sectional view showing the hydraulic rotary machine in a different position to FIG. 1.
Figure 3:
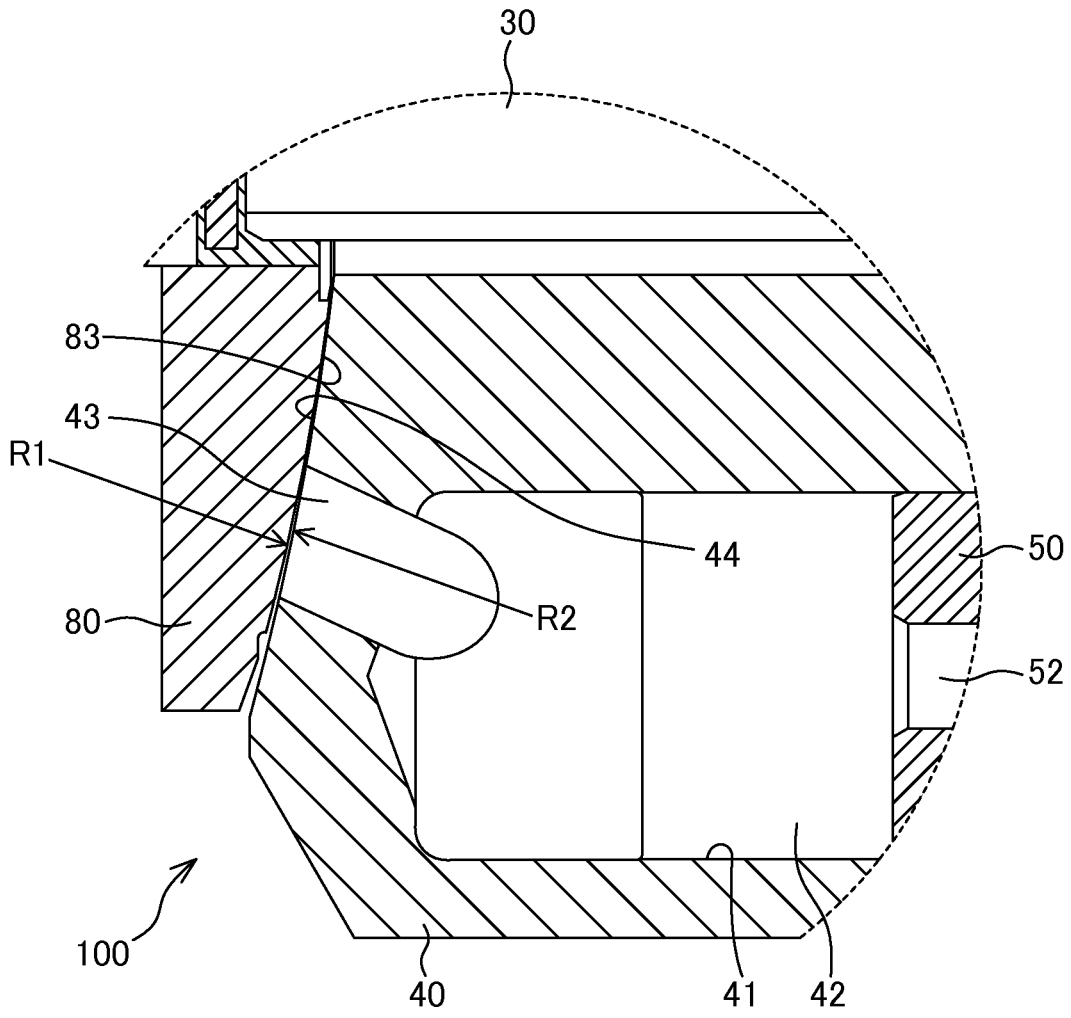
FIG. 3 is an enlarged sectional view of a cylinder block and a valve plate constituting the hydraulic rotary machine.

The hydraulic rotary machine 100 shown in FIGS. 1 to 3 is an example of a fluid pressure rotary machine that is installed in a vehicle such as a construction machine or an agricultural machine and used as a piston pump that supplies working oil to an actuator. In this case, a drive shaft 30 is driven to rotate by power from an engine installed in the vehicle, whereby the hydraulic rotary machine 100 supplies working oil to the actuator.

As shown in FIG. 1, the hydraulic rotary machine 100 includes a closed end cylinder-shaped case 10, an end block 20 provided to close an open end of the case 10, the drive shaft 30 (a rotary shaft) supported on the case 10 and the end block 20 to be free to rotate, and a cylinder block 40 housed in a housing chamber 11 that is defined by the case 10 and the end block 20.

As shown in FIGS. 1 and 2, the drive shaft 30 is a rod-shaped member that is driven to rotate on the basis of power from the engine provided in the vehicle. A tip end portion of the drive shaft 30 projects to the outside through an insertion hole 21 in the end block 20, and the power of the engine is transmitted to the tip end portion. A rear end portion of the drive shaft 30 is connected to a drive shaft 1A of a gear pump 1 used to provide a pilot pressure.

The drive shaft 30 is supported to be free to rotate by a bearing 31 provided in the insertion hole 21 in the end block 20 and a bearing 32 provided in a bottom portion of the case 10. The bearings 31, 32 are ball bearings.

Further, the cylinder block 40 is fixed in an axial direction central position of the drive shaft 30 so as to rotate in response to rotation of the drive shaft 30.

The cylinder block 40 is a closed end cylinder-shaped member. The cylinder block 40 is housed in the housing chamber 11 of the case 10. A plurality of cylinder bores 41 extending parallel to the drive shaft 30 are formed in the cylinder block 40. The cylinder bores 41 are disposed at fixed intervals on an identical circumference centering on an axial center of the drive shaft 30. A piston 50 is inserted to be free to reciprocate into each cylinder bore 41 such that a volume chamber 42 is defined thereby.

A shoe 60 is connected to a spherical portion 51 on a tip end of the piston 50 to be free to rotate. The shoe 60 is attached to the spherical portion 51 of the piston 50 via a spherical surface seat 60A formed as a spherical recessed portion. The shoe 60 provided on each piston 50 is attached to a through hole formed in a disc-shaped retainer plate 61. The shoe 60 is configured to be in surface contact with a swash plate 70 housed in the housing chamber 11 via the retainer plate 61. The retainer plate 61 is provided to be free to rotate relative to a retainer holder 62 disposed on an outer periphery of the drive shaft 30.

It should be noted that in the hydraulic rotary machine 100, the swash plate 70 is disposed to be free to rotate within the housing chamber 11 so that a tilt angle thereof can be adjusted. However, the swash plate 70 may be fixed to the end block 20 so that the tilt angle thereof is fixed.

Through holes 52, 60B are formed respectively in the piston 50 and the shoe 60 to supply a part of the working oil in the volume chamber 42 to a sliding surface between the shoe 60 and the swash plate 70. By supplying the working oil through the through holes 52, 60B, the shoe 60 can be caused to slide smoothly relative to the swash plate 70.

A valve plate 80 against which an end surface of the cylinder block 40 slides is fixed to the bottom portion of the case 10. An intake port 81 for suctioning the working oil and a discharge port 82 for discharging the working oil are formed in the valve plate 80. Further, a through hole 43 is formed in a bottom portion of the cylinder block 40 for each volume chamber 42.

An intake port 12 of the case 10 communicates with the volume chamber 42 through the intake port 81 in the valve plate 80 and the through hole 43 in the cylinder block 40. A discharge port 13 of the case 10, meanwhile, communicates with the volume chamber 42 through the discharge port 82 in the valve plate 80 and the through hole 43 in the cylinder block 40.

In the hydraulic rotary machine 100 serving as a piston pump, when the drive shaft 30 is driven to rotate by the power of the engine such that the cylinder block 40 rotates, the respective shoes 60 slide relative to the swash plate 70 such that the respective pistons 50 reciprocate through the cylinder bores 41 by a stroke amount corresponding to the tilt angle of the swash plate 70. When each piston 50 reciprocates, a volume of each volume chamber 42 increases and decreases (expands and contracts).

Working oil is suctioned into the volume chamber 42 that expands as the cylinder block 40 rotates through the intake port 12 in the case 10, the intake port 81 in the valve plate 80, and the through hole 43 in the cylinder block 40. Meanwhile, working oil is discharged from the volume chamber 42 that contracts as the cylinder block 40 rotates through the through hole 43 in the cylinder block 40, the discharge port 82 in the valve plate 80, and the discharge port 13 in the case 10.

Hence, in the hydraulic rotary machine 100 serving as a piston pump, the working oil is suctioned and discharged continuously as the cylinder block 40 rotates.

As shown in FIGS. 2 and 3, the valve plate 80 of the hydraulic rotary machine 100 is disposed so as to slide against the end surface of the cylinder block 40.

The valve plate 80 includes a sliding surface 83 formed to project in a spherical shape toward the cylinder block 40 side. The cylinder block 40, meanwhile, includes a sliding surface 44 formed as a spherical indentation corresponding to the shape of the sliding surface 83 of the valve plate 80. A curvature radius R2 of the sliding surface 44 of the cylinder block 40 is set to be larger than a curvature radius R1 of the sliding surface 83 of the valve plate 80.

With these settings, as shown in FIG. 3, the sliding surface 83 of the valve plate 80 and the sliding surface 44 of the cylinder block 40 slide against each other without gaps in a central part. However, a minute gap is formed between the sliding surface 83 of the valve plate 80 and the sliding surface 44 of the cylinder block 40 in an outer edge part positioned on a radial direction outer side of the central part. This minute gap increases toward the radial direction outer side of the valve plate 80 and the cylinder block 40.

Since the minute gap exists between the respective sliding surfaces 83, 44 of the outer edge parts of the valve plate 80 and the cylinder block 40, even when the drive shaft 30 is bent by the reaction force that acts on the piston 50 from the swash plate 70 side via the shoe 60 during an operation of the hydraulic rotary machine 100 such that the cylinder block 40 tilts, a contact pressure by which the outer edge part of the sliding surface 83 of the valve plate 80 contacts the cylinder block 40 does not become excessively large.

Incidentally, when the valve plate 80 and the cylinder block 40 are configured such that the minute gap is formed, a part of the working oil in the volume chamber 42 leaks out to the housing chamber 11 side through the minute gap.

Figure 4:
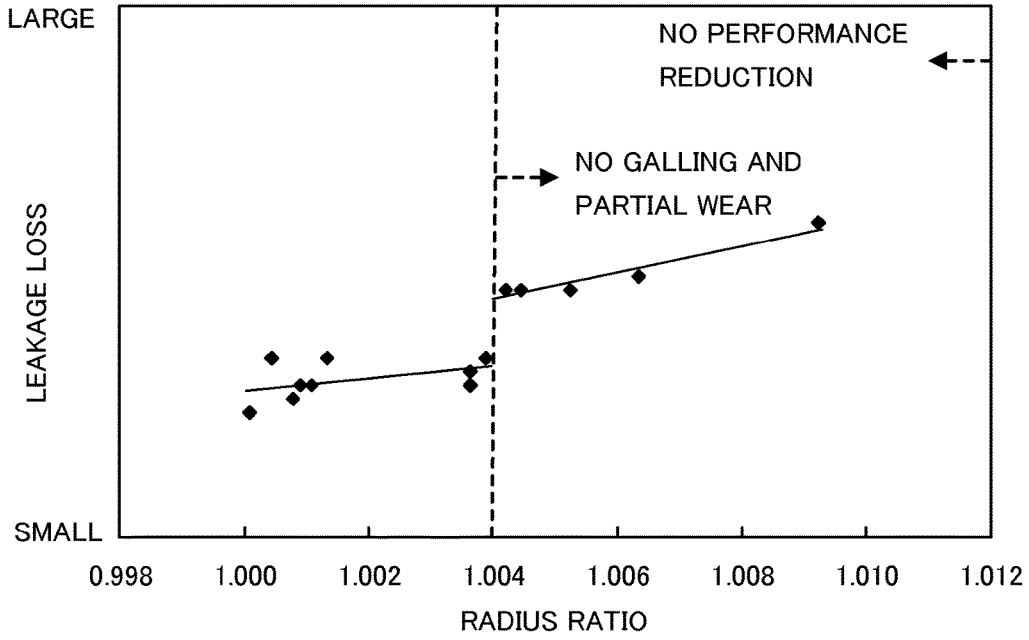
FIG. 4 is a view showing a relationship between leakage loss and a radius ratio between respective sliding surfaces of the cylinder block and the valve plate.

FIG. 4 is a view showing a relationship between a radius ratio obtained by dividing the curvature radius R2 of the sliding surface 44 of the cylinder block 40 by the curvature radius R1 of the sliding surface 83 of the valve plate 80, and a leakage loss indicating an extent to which working oil leaks through the minute gap. It should be noted that in the hydraulic rotary machine 100 according to this embodiment, the curvature radius R2 of the sliding surface 44 of the cylinder block 40 is set to be larger than the curvature radius R1 of the sliding surface 83 of the valve plate 80, and therefore the radius ratio takes a larger value than 1.

As shown in FIG. 4, the working oil is more likely to leak through the minute gap, leading to an increase in leakage loss, as the radius ratio increases, or in other words as the curvature radius R2 of the sliding surface 44 of the cylinder block 40 becomes larger than the curvature radius R1 of the sliding surface 83 of the valve plate 80.

In FIG. 4, which was obtained through experiments performed to check the leakage loss, it can be seen that when the respective sliding surfaces 44, 83 of the cylinder block 40 and the valve plate 80 are configured such that the radius ratio is smaller than 1.004, galling, partial wear, and so on caused by the reaction force acting on the piston 50 occurs, albeit to a small extent, on the outer edge parts of the respective sliding surfaces 44, 83 of the cylinder block 40 and the valve plate 80.

To prevent partial wear and so on more reliably, therefore, the respective sliding surfaces 44, 83 of the cylinder block 40 and the valve plate 80 are preferably configured such that the radius ratio equals or exceeds 1.004.

Further, although leakage loss occurring at a radius ratio of 1.009 or more is not shown in FIG. 4, the leakage loss increases steadily as the radius ratio increases. In particular, when the radius ratio equals or exceeds 1.004, although partial wear and the like can be prevented, leakage loss tends to increase easily. From the viewpoint of preventing a reduction in a pump performance caused by leakage loss, the respective sliding surfaces 44, 83 of the cylinder block 40 and the valve plate 80 are preferably configured such that the radius ratio is equal to or smaller than 1.012.

With the hydraulic rotary machine 100 according to the embodiment described above, following effects can be obtained.

In the hydraulic rotary machine 100 serving as a piston pump, the curvature radius R2 of the sliding surface 44 of the cylinder block 40 is set to be larger than the curvature radius R1 of the sliding surface 83 of the valve plate 80, and therefore a minute gap is formed between the respective outer edge parts of the sliding surface 83 of the valve plate 80 and the sliding surface 44 of the cylinder block 40. Hence, even when the drive shaft 30 is bent by the reaction force that acts on the piston 50 from the swash plate 70 side via the shoe 60 during an operation of the hydraulic rotary machine 100 such that the cylinder block 40 tilts, the contact pressure by which the outer edge part of the sliding surface 83 of the valve plate 80 contacts the cylinder block 40 does not become excessively large. As a result, partial wear on the cylinder block 40 and the valve plate 80 can be suppressed.

Further, even when respective centers of the cylinder block 40 and the valve plate 80 are offset from each other due to a manufacturing error or the like occurring during construction, partial wear and the like on the cylinder block 40 and the valve plate 80 due to this positional offset can be suppressed. As a result, a degree of freedom in the construction and design of the members constituting the hydraulic rotary machine 100, such as the cylinder block 40 and the valve plate 80, can be improved.

Furthermore, by configuring the respective sliding surfaces 44, 83 of the cylinder block 40 and the valve plate 80 such that the radius ratio obtained by dividing the curvature radius R2 of the sliding surface 44 of the cylinder block 40 by the curvature radius R1 of the sliding surface 83 of the valve plate 80 equals or exceeds 1.004, partial wear on the cylinder block 40 and the valve plate 80 can be prevented even more reliably.

Moreover, by configuring the respective sliding surfaces 44, 83 of the cylinder block 40 and the valve plate 80 such that the radius ratio is equal to or smaller than 1.012, leakage loss can be prevented from increasing excessively, and as a result, a reduction in the performance of the hydraulic rotary machine 100 can be avoided.

Second Embodiment

Figure 5:
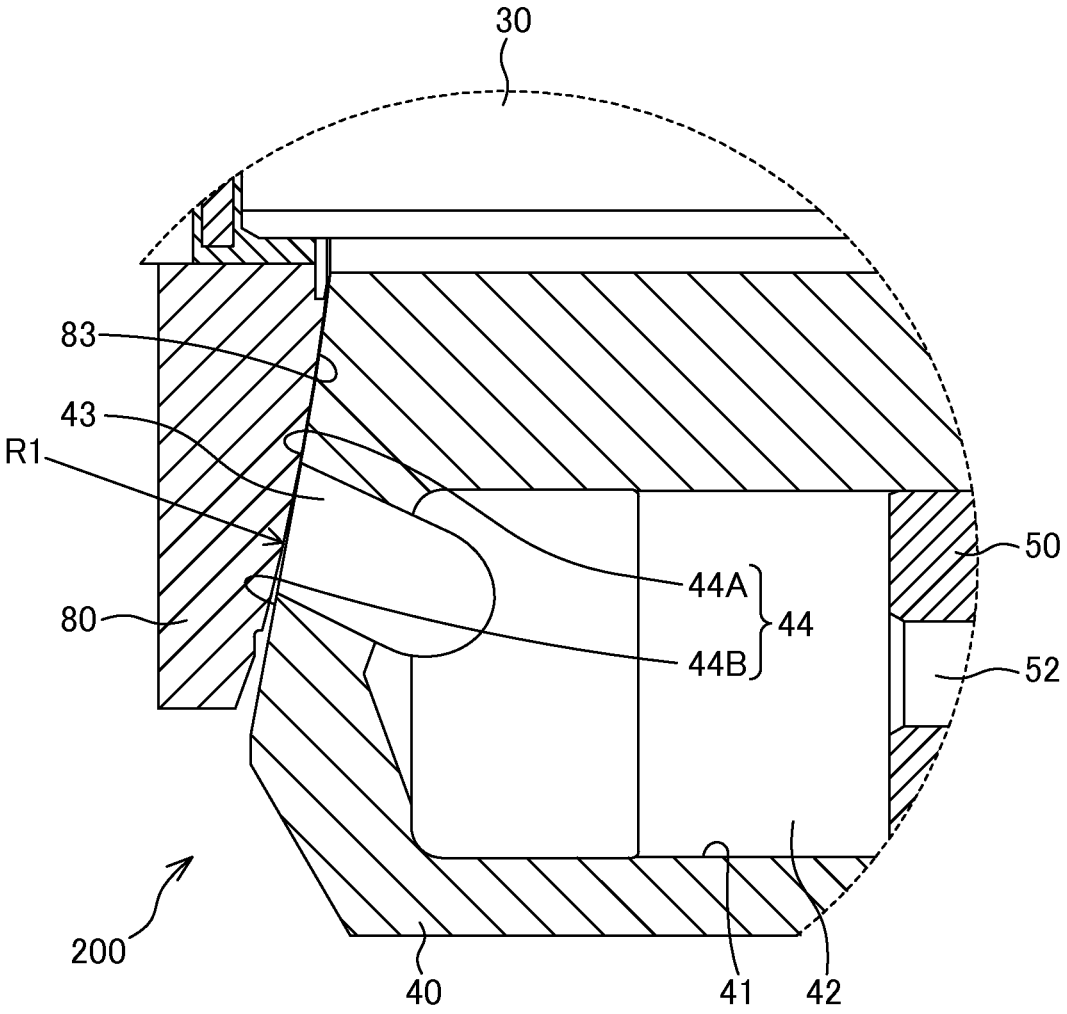
FIG. 5 is a sectional view showing a hydraulic rotary machine according to a second embodiment of the present invention.

Referring to FIG. 5, a hydraulic rotary machine 200 (a fluid pressure rotary machine) according to a second embodiment of the present invention will be described. The hydraulic rotary machine 200 according to the second embodiment is substantially identical to the hydraulic rotary machine 100 according to the first embodiment, but differs in the configuration of the sliding surface 44 of the cylinder block 40. Different configurations to the first embodiment will be described below, and identical reference symbols have been allocated to configurations that are identical to the first embodiment, while description thereof has been omitted.

In the hydraulic rotary machine 100 according to the first embodiment, the sliding surface 44 of the cylinder block 40 is formed as a spherical recess. In the hydraulic rotary machine 200 according to the second embodiment, on the other hand, a central portion 44A of the sliding surface 44 of the cylinder block 40 is formed as a spherical recess, while an outside portion 44B of the sliding surface 44, positioned on the radial direction outer side of the central portion 44A, is formed as a tapered surface.

As shown in FIG. 5, the central portion 44A of the sliding surface 44 of the cylinder block 40 is formed such that a curvature radius thereof is identical to the curvature radius R1 of the sliding surface 83 of the valve plate 80. Further, the outside portion 44B of the sliding surface 44 is formed as a tapered surface (an inclined surface) extending in a tangential direction (an extension direction of a tangent to an outermost position of the central portion 44A) from the outer side of the central portion 44A.

By configuring the central portion 44A and the outside portion 44B of the sliding surface 44 of the cylinder block 40 as described above, a minute gap can be formed between the sliding surface 83 of the valve plate 80 and the sliding surface 44 of the cylinder block 40 in the outer edge part. As a result, the contact pressure by which the outer edge part of the sliding surface 83 of the valve plate 80 contacts the cylinder block 40 does not become excessively large, and therefore partial wear on the cylinder block 40 and the valve plate 80 can be suppressed.

It should be noted that in the hydraulic rotary machine 200 according to the second embodiment, the outside portion 44B of the sliding surface 44 of the cylinder block 40 is formed as a tapered surface, but the outside portion 44B may be formed as a recessed surface constituted by a spherical indentation. In this case, a minute gap can be formed between the sliding surface 83 of the valve plate 80 and the sliding surface 44 of the cylinder block 40 in the outer edge part by setting a curvature radius of the outside portion 44B to be larger than the curvature radius R1 of the sliding surface 83 of the valve plate 80.

Embodiments of the present invention were described above, but the above embodiments merely illustrate a part of examples of applications of the present invention, and the technical scope of the present invention is not limited to the specific configurations described in the embodiments.

In the first and second embodiments, the hydraulic rotary machine 100, 200 is used as a piston pump, but the hydraulic rotary machine 100, 200 may be used as a piston motor. In this case, working oil is supplied to the hydraulic rotary machine 100, 200 externally, and the drive shaft 30 is driven to rotate by the supplied working oil. Hence, the technical idea of the present invention may be applied to a piston pump/motor serving as a hydraulic rotary machine.

Further, in the hydraulic rotary machines 100, 200 according to the first and second embodiments, working oil is used as a working fluid, but a working fluid such as water, a water-soluble replacement fluid, or the like may be used instead of working oil.

The present application claims priority based on Japanese Patent Application No. 2012-179305, filed with the Japan Patent Office on Aug. 13, 2012, the entire contents of which are incorporated herein by reference.

The invention claimed is:

1. A fluid pressure rotary machine comprising:

a cylinder block that is fixed to a rotary shaft and includes a plurality of cylinder bores; a piston disposed to be free to slide in each cylinder bore such that a volume chamber is defined thereby;

a swash plate that causes the piston to reciprocate as the cylinder block rotates such that the volume chamber expands and contracts; and a valve plate that slides against the cylinder block and includes an intake port and a discharge port communicating with the volume chamber, wherein the valve plate includes a sliding surface formed to project in a spherical shape against the cylinder block, the cylinder block includes a sliding surface formed as an indentation in a spherical shape corresponding to the shape of the sliding surface of the valve plate, and a minute gap is formed between the sliding surface of the valve plate and the sliding surface of the cylinder block in an outer edge position of the cylinder block, the minute gap being formed by configuring a radius of curvature of the sliding surface of the cylinder block to be larger than a radius of curvature of the sliding surface of the valve plate;

wherein the respective sliding surfaces of the cylinder block and the valve plate are configured such that a radius ratio obtained by dividing the radius of curvature of the sliding surface of the cylinder block by the radius of curvature of the sliding surface of the valve plate is in a range of 1.004 to 1.012.

2. A fluid pressure rotary machine, comprising:

a cylinder block that is fixed to a rotary shaft and includes a plurality of cylinder bores;

a piston disposed to be free to slide in each cylinder bore such that a volume chamber is defined thereby;

a swash plate that causes the piston to reciprocate as the cylinder block rotates such that the volume chamber expands and contracts; and a valve plate that slides against the cylinder block and includes an intake port and a discharge port communicating with the volume chamber, wherein the valve plate includes a sliding surface formed to project in a spherical shape against the cylinder block, the cylinder block includes a sliding surface formed as an indentation corresponding to the shape of the sliding surface of the valve plate, the sliding surface of the cylinder block including a central portion and an outside portion positioned on an outer side of the central portion, the central portion having a spherical shape such that a radius of curvature thereof is identical to a radius of curvature of the sliding surface of the valve plate, the outside portion extending in a tangential direction from the outer side of the central portion, the outside portion having a spherical shape such that a radius of curvature thereof is larger than the radius of curvature of the sliding surface of the valve plate, and a minute gap is formed between the sliding surface of the valve plate and the outside portion of the sliding surface of the cylinder block.

* * * * *